United States Patent [19]

Valley et al.

[11] Patent Number: 4,626,769

[45] Date of Patent: Dec. 2, 1986

[54] VOLTAGE/CURRENT SOURCE

[75] Inventors: David P. Valley, Tyngsboro; Allan Ryan, Billerica, both of Mass.

[73] Assignee: Analog Devices, Inc., Norwood, Mass.

[21] Appl. No.: 844,212

[22] Filed: Mar. 18, 1986

Related U.S. Application Data

[63] Continuation of Ser. No. 711,192, Mar. 13, 1985, abandoned.

[51] Int. Cl.[4] ..... G05F 1/10

[52] U.S. Cl. ..... 323/283; 323/285; 324/76 R; 364/162

[58] Field of Search ..... 323/282, 283, 284, 285; 324/76 R, 102, 103 R, 123 R, 123 C, 98, 99 R; 364/161, 162, 163; 361/2-7

[56] References Cited

U.S. PATENT DOCUMENTS

| | | | |
|---|---|---|---|
| 4,234,832 | 11/1980 | Dreinhoefer et al. | 318/146 |
| 4,250,543 | 2/1981 | Smith et al. | 364/162 |
| 4,365,302 | 12/1982 | Elms | 324/76 R |
| 4,396,986 | 8/1983 | Salesky | 324/76 R |
| 4,438,498 | 3/1984 | Sekel et al. | 323/283 X |
| 4,466,054 | 8/1984 | Shigemasa et al. | 364/162 |

FOREIGN PATENT DOCUMENTS

| | | |
|---|---|---|
| 0066785 | 12/1982 | European Pat. Off. . |
| 2615752 | 10/1977 | Fed. Rep. of Germany . |
| 2262878 | 9/1975 | France . |

*Primary Examiner*—Peter S. Wong

[57] ABSTRACT

A voltage/current source includes a loop controller (24) that digitally determines the control signals that must be applied to a driver amplifier (34) to achieve the desired load voltage or current. The analog outputs of current- and voltage-sensing amplifiers (38 and 68) are converted by analog-to-digital converters (52 and 74) to digital feedback signals that the loop controller (24) uses in determining what control signals to generate. The loop controller (24) keeps the driver-amplifier output voltage equal to the load voltage until switch contacts (30) connect the source to the load so that connection-caused transients are minimized. The loop controller (24) includes read-write memory (25) in which it stores program instructions and operational parameters, so the source can readily change its feedback characteristics. Furthermore, output-voltage limits are readily imposed by software limits on the driver-amplifier input voltage, so no elaborate clamping circuitry at the output port of the source is necessary to prevent output-voltage overshoot.

18 Claims, 2 Drawing Figures

VOLTAGE/CURRENT SOURCE

This application is a continuation, of application Ser. No. 711,192, filed Mar. 13, 1985 now abandoned.

BACKGROUND OF THE INVENTION

The present invention is directed to the voltage sources and current sources, particularly those of type employed in equipment for testing analog circuits.

In testing analog circuits—and sometimes in testing digital circuits as well—it is often necessary to drive or draw a predetermined current or apply a predetermined voltage having very specific characteristics. For instance, in order to test the noise rejection of a power supply, it may be desirable to apply a signal that is a combination of a d.c. value and an a.c. component. In order to test the ability of the supply to carry a load, a current source or sink may be used at the output port of the power supply under test to present it with a well-defined load.

When such current or voltage sources are incorporated in automated test equipment, they can be subject to certain problems. For instance, a current source in such equipment must be connected and disconnected frequently to devices under test, and there is a tendency for the current source, which is attempting to drive a very high impedance (an open circuit) just before connection, to generate high transient voltages when the connection occurs. This can be destructive to the device under test, and it is not beneficial to the test equipment, either.

Additionally, certain devices under test have voltage limits that the current source should not exceed. In order to avoid exceeding such limits, limiting devices are often included in the feedback network of the current source, but there is an inherent delay in such arrangements—they can only react to overvoltages at the output, not anticipate them—so the voltage clamping cannot be entirely effective unless elaborate additional circuitry is provided at the output port of the current source.

Finally, the current sources employed in automated test equipment are usually employed with a wide variety of loads. Such sources are feedback devices, and the type of feedback network that will result in a stable operation with one type of load can be highly unstable with other types. Accordingly, it has been necessary in the past to provide many alternative types of feedback networks—and the switching circuitry for choosing among them—in order to deal effectively with different types of loads.

The object of the present invention is to supply current or voltage in a manner in which clamping functions are carried out readily without additional circuitry, in which switching transients are largely eliminated, and in which adjustment of feedback is accomplished without a lot of alternative circuitry and the attendant switching.

SUMMARY OF THE INVENTION

Certain of the foregoing and related objects are achieved by sensing the voltage across a load before the electronic amplifier in a current source is connected across the load. The output voltage of the amplifier is set to the sensed load voltage while the amplifier is still disconnected from the load. With the amplifier output voltage equal to the load voltage, the amplifier is connected to the load, and its output voltage is then varied until the desired load current is reached. Since the amplifier output voltage is controlled in response to the load voltage, rather than in response to the output current, before the amplifier is connected to the load, large switching transients are avoided.

In accordance with another aspect of the invention, control of the electronic amplifier is performed by digital circuitry that receives digital representations of signals from an output-current sensor. The digital circuitry computes the difference between these signals and a reference digital signal that represents the desired current. It then processes the resultant difference value to generate a proportional-integral-derivative (PID) feedback signal. The particular parameters used in generating the PID value depend on the particular load and are chosen to insure system stability when that load is being driven. The digital circuit generates a control output representative of the PID value. This output is converted to analog form and used as the input signal to the electronic amplifier that drives the load.

The digital circuitry includes read-write storage and thus can readily be programmed to change the PID parameters in accordance with the load with which the source is being used. Since the proportional-integral-derivative processing is performed digitally, these parameters can readily be changed by changing the contents of read-write memory containing them. Thus, a great degree of versatility results without the use of a large amount of additional hardware.

According to still another aspect of the invention, voltage clamping with no overshoot is readily achieved without extensive additional hardware. Specifically, it is only necessary to include in the algorithm for generating the control signal a test to determine whether the PID value is outside predetermined limits. If it is outside the predetermined limits, the signal used as the amplifier input is determined by a predetermined limit value rather than by the PID value. In this way, the output voltage is clamped without additional hardware and without overshoot.

BRIEF DESCRIPTION OF THE DRAWINGS

These and further features and advantages of the present invention are described in connection with the accompanying drawings, in which.

DETAILED DESCRIPTION OF THE PREFERRED EMBODIMENTS

Figure 1:
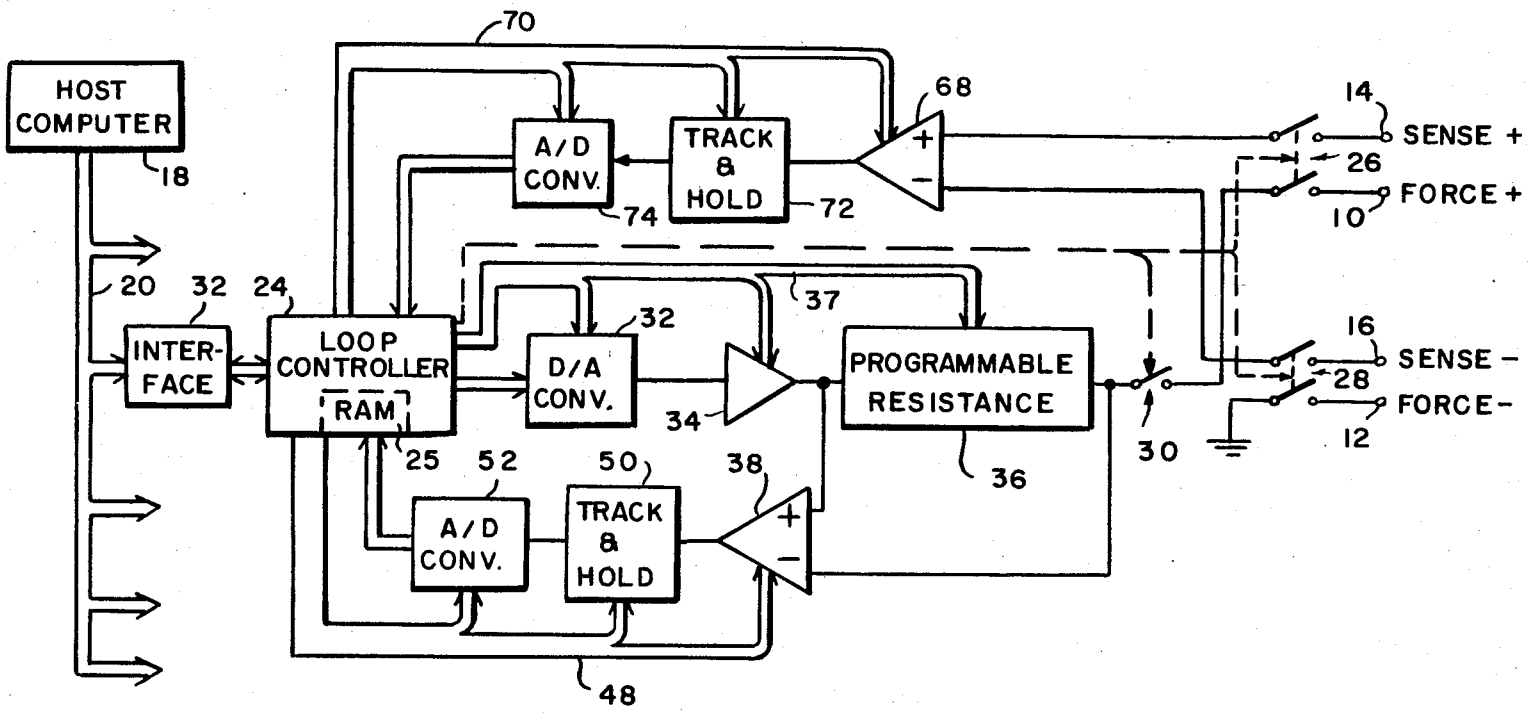
FIG. 1 is a simplified block diagram of a voltage/current source embodying the teachings of the present invention.

FIG. 1 illustrates a portion of a test system for testing electronic circuits. This portion drives a port of a device under test (DUT) with a predetermined voltage or current. The DUT is typically placed in a fixture (not shown), and placement of the DUT into the fixture connects DUT test nodes across force output terminals 10 and 12 for application of the desired voltage or current. Placement of the DUT into the fixture also connects sense terminals 14 and 16 to appropriate DUT nodes, often the same nodes as those to which the force terminals 10 and 12 are connected.

When it is desired to drive the nodes to which the force terminals 10 and 12 are connected, a host computer 18 that controls the entire test system sends signals along a bus 20 to an interface circuit 22 to cause it to pass information to a loop controller 24 indicating that two sets of relay contacts 26 and 28 should be closed. The loop controller 24 typically includes a microprocessor and related circuitry, including read/write memory 25 that stores information received from the host computer 18. This information includes program instructions and the values of various parameters that the loop controller 24 must use in performing its functions. Having stored information indicating that the relay contacts 26 and 28 should be closed, the loop controller 24 operates relay drivers (not shown) to close these contacts. Closure of contacts 26 and 28 connects the force terminals 10 and 12 to the system ground and to a further set of contacts 30.

To drive the nodes to which the force terminals 10 and 12 are connected, the loop controller 24 sends digital signals to a digital-to-analog converter 32. The digital-to-analog converter 32 converts these digital signals to corresponding analog signals, which it applies to the input terminal of a driver amplifier 34 to cause it to apply the desired output voltage to the DUT. The driver amplifier 34 transmits amplified output signals through a programmable resistance 36 to relay contacts 30, which the loop controller 24 causes to close after closure of contacts 26 and 28, as will be discussed in more detail below. Closure of contacts 30 completes the connection of the driver amplifier 34 to the DUT to enable the driver amplifier 34 to drive it. The gain of the driver amplifier 34, the value of the programmable resistance 36, and the time of conversion by the digital-to-analog converter 32 are all controlled in response to control signals on lines 37 from the loop controller 24.

If the circuit of FIG. 1 is acting as a current source, the loop controller 24 sets the value of its digital output in accordance with the output current of the driver amplifier 34. Specifically, a current-sensor amplifier 38 receives as its input the potential difference across the programmable resistance 36. This potential difference is proportional to the output current of the driver amplifier 34. In response to signals placed on lines 48 by the loop controller 24, a track-and-hold circuit 50 holds the output of the current-sensing amplifier 38. An analog-to-digital converter 52 converts this held analog signal to digital form, also in response to signals from the loop controller 24 on lines 48, and sends the resultant digital signals to the loop controller 24, which is thereby informed of the value of the driver-amplifier output current. The loop controller 24 computes the difference between this difference value and a reference value previously sent to the loop controller 24 by the host computer 18.

In accordance with parameters received from the host computer 18, the loop controller 24 digitally processes the feedback signal from analog-to-digital converter 52 to compute what we will call a PID (proportional-integral-derivative) value. This is a value that is in general the sum of three components, each of which is multiplied by an associated coefficient: the difference value itself, the integral of the difference value, and the derivative of the difference value. The stored coefficients are dependent on the electrical characteristics of the expected load and are among the parameters sent by the host computer 18. In many cases, at least one of the coefficients is zero. The signals that the loop controller 24 sends to the digital-to-analog converter 38 usually represent this PID value.

However, the PID value would sometimes result in an output voltage that is outside limits that should be observed at the DUT nodes to which the force terminals are connected. By employing the digital control arrangement of the present invention, it is easier to prevent such overvoltages completely than it is when analog schemes are used. Analog current sources sometimes include some type of circuitry in the feedback path to impose voltage limits, but the location of such circuitry in the feedback path makes it ineffective for prevention of rapidly occurring overvoltages. Although analog current sources could be made to include some type of clamping circuit at the output port of the driver amplifier rather than in the feedback path, such clamping circuits would often add prohibitively to the complexity and cost of the source. With the digital control of the preseht invention, however, the clamping is readily performed as a part of computing the value of the signals to be applied to the digital-to-analog converter 32.

Figure 2:
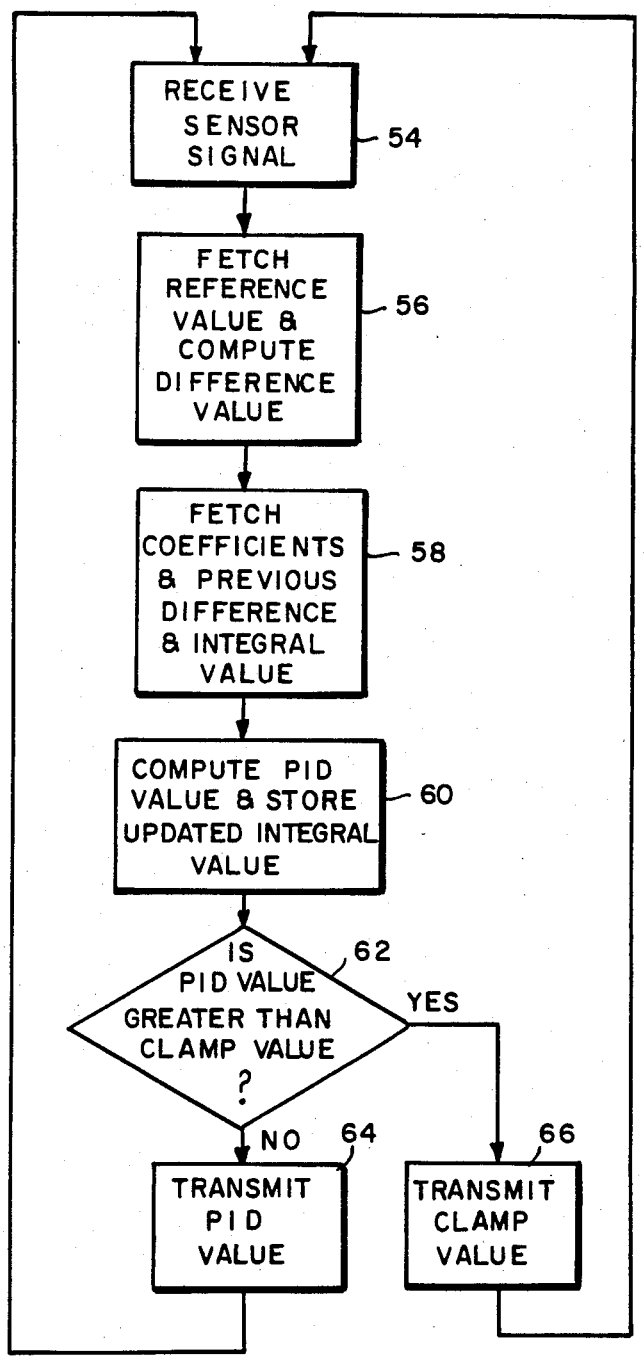
FIG. 2 is a simplified flow chart illustrating the clamping function performed by system software.

The manner in which the clamping is performed is illustrated in FIG. 2, which depicts in simplified form the relevant parts of the program loop executed by the loop controller 24. The top flow-chart block 54 represents the loop controller's reception of the sensor-signal value from the analog-to-digital converter 52. The loop controller 24 then fetches the reference value most recently supplied by the host computer 18 and computes the difference between the reference value and the sensor-signal value, as block 56 indicates. In order to compute the PID value, the loop controller 24 must fetch the PID coefficients. It must also fetch the previous difference value if the derivative coefficient is not zero. If the coefficient of the integral PID component is not zero, it must further fetch a stored value representing the sum of the previously computed difference values. Block 58 represents these steps.

The loop controller then computes the PID value. If the coefficient for the integral coefficient is not zero, this involves updating the cumulative difference signal, which must be stored. Block 60 represents these steps.

To impose the clamping limits, the loop controller simply performs a test to determine whether the PID value is within predetermined limits. In the illustrated embodiment, this test consists of determining whether the PID value is greater than a predetermined clamp value, as block 62 indicates. If the PID value is not greater than the clamp value, transmission to the digital-to-analog converter 32 of signals representing this value will not result in a driver-amplifier output voltage that exceeds the predetermined voltage limit, so the loop controller 24 transmits such signals, as block 64 indicates. If the PID value is greater than the clamp value, on the other hand, the output of the driver amplifier 34 would exceed the voltage limit if signals representing the PID value were sent to the digital-to-analog converter 32. Accordingly, the loop controller 24 instead sends signals representing the clamp value, as block 66 indicates.

While the circuitry of FIG. 1 is actually driving DUT nodes in its current-source mode, it controls the driver-amplifier output voltage in response to the driver-amplifier output current. Before the driver amplifier 34 is connected to the DUT, however, there is no output current, so the tendency would be for the driver-amplifier output to be driven to the power-supply voltage if control were based on the output current before contacts 30 are closed. This would be undesirable because it would likely result in large transients when the connection is finally made. To avoid such a result, a "soft connect" feature is provided in accordance with the present invention.

To implement the soft-connect feature, the loop controller 24 does not close contacts 30 until after it closes contacts 26 and 28. Closure of contacts 26 and 28 connects the sense terminals across the input terminals of a voltage-sensing amplifier 68, whose gain is controlled in response to signals that the loop controller 24 sends over control lines 70. Other signals on control lines 70 first cause a second track-and-hold circuit 72 to hold a recent output of the voltage-sensing amplifier 68 and then cause another analog-to-digital converter 74 to convert the held signal to digital signals. The loop controller 24 receives these signals and is thereby informed of the voltage across the DUT terminals that are to be driven.

All of this occurs before contacts 30 are closed. During this time, the quantity upon which the loop controller 24 bases the driver-amplifier output is the sensed DUT voltage rather than the amplifier current. Specifically, the loop controller 24 operates the driver amplifier 34 to bring its output into equality with the DUT voltage. When the voltage output of the driver amplifier 34 reaches the DUT voltage, the the loop controller 24 closes contacts 30 and only then begins to control the amplifier in response to the output current. As a result, there is no difference between the DUT voltage and the driver-amplifier output voltage to cause transients when contacts 30 close.

The foregoing portion of the description has concentrated on operation of the circuit of FIG. 1 as a current source. That circuit can readily be adapted for use as a voltage source, too, but a detailed description of its operation in that mode is not necessary. It suffices to say that, to change from the current-source mode to the voltage-source mode, the host computer 18 simply down-loads new programming into the loop controller 24 and supplies it with a reference value representing the intended DUT voltage. In accordance with the new programming, computation of the PID value is based on the sensed DUT voltage rather than on the the sensed amplifier current. The soft-connect feature can be used in the voltage-source mode, although that feature is not as important in the voltage-source mode as it is in the current-source mode.

It is apparent as a result of the foregoing description that the present invention adds a high degree of versatility to a voltage or current source. It enables the characteristics of the control system to be readily adapted to the a wide variety of different types of loads without excessive alternative circuitry, and it prevents overvoltages effectively without the need for elaborate clamping circuitry at its output port. Furthermore, its soft-connect feature eliminates connection transients that would otherwise occur, particularly in the current-source mode. The present invention thus represents a significant advance in the art.

We claim:

1. A method of employing an electronic amplifier to drive a load with a desired load current comprising the steps of:

A. sensing the load voltage with the amplifier disconnected from the load;

B. setting the output voltage of the amplifier substantially equal to the sensed load voltage;

C. when the amplifier output voltage has reached the load voltage, connecting the amplifier to the load;

D. thereafter sensing the resultant load current; and

E. controlling the amplifier output voltage to cause the sensed load current substantially to equal the desired load current.

2. A method of employing an electronic amplifier to apply a desired voltage to a load comprising the steps of:

A. sensing the load voltage with the amplifier disconnected from the load;

B. setting the output voltages of the amplifier to the sensed load voltage;

C. when the amplifier output voltage has reached the load voltage, connecting the amplifier to the load;

D. thereafter sensing the resultant load voltage; and

E. controlling the amplifier output voltage to cause the sensed load voltage substantially to equal the desired load voltage.

3. A method of driving a desired load current through a load by using an electronic amplifier, having an amplifier output port adapted for connection to the load, that produces at the amplifier output port an amplifier output vbltage determined by amplifier input signals applied thereto, the method comprising the steps of:

A. connecting the amplifier output port across the load;

B. sensing the amplifier output current and producing digital sensor signals indicative thereof;

C. digitally processing the digital sensor signals to determine a digital difference value representing the difference between the value represented by the digital sensor signals and a predetermined reference value representing the desired load current and to compute a digital proportional-integral-derivative (PID) value from the difference value; and D. applying to the electronic amplifier as an analog amplifier input signal the voltage represented by the digital PID value to cause the amplifier output current to tend to equal the desired load current indicated by the reference value.

4. A method of applying a desired load voltage to a load by using an electronic amplifier, having an amplifier output port adapted for connection to the load, for producing at the amplifier output port an amplifier output voltage determined by amplifier input signals applied thereto, the method comprising the steps of:

A. connecting the amplifier output port across the load;

B. sensing the load voltage and producing digital sensor signals indicative thereof;

C. digitally processing the digital sensor signals to determine a digital difference value representing the difference between the value represented by the digital sensor signals and a predetermined reference value representing the desired load voltage and to compute a digital proportional-integral-derivative (PID) value from the difference value; and D. applying to the electronic amplifier as an analog amplifier input signal the voltage represented by the digital PID value to cause the amplifier output current to tend to equal the desired load voltage indicated by the reference value.

5. A current source, having a current-source output port adapted for connection to a load, for driving a desired load current through a load connected to the current-source output port, the current source comprising:

A. an electronic amplifier, having an amplifier output port, for producing at the amplifier output port an amplifier output voltage determined by amplifier input signals applied thereto;

B. switch means connected between the amplifier and current-source output ports and operable by application of control signals thereto selectively to connect and disconnect the amplifier output port to and from the current-source output port;

C. a current sensor for sensing the amplifier output current and producing a current-sensor signal indicative thereof;

D. a voltage sensor for sensing the load voltage at the current-source output port and producing a voltage-sensor signal indicative thereof; and E. control circuitry, connected for reception of the current-sensor and voltage-sensor signals and for application of control signals to the switch means and amplifier input signals to the electronic amplifier, for:

i. applying amplifier input signals to the electronic amplifier, while the switch means keeps the current-source output port disconnected from the amplifier port, to set the amplifier output voltage equal to the load voltage indicated by the voltage-sensor signal, ii. applying control signals to the switch means to cause it to connect the amplifier output port to the current-source output port while the amplifier output voltage equals the load voltage, and iii. thereafter applying amplifier input signals to the amplifier to cause the amplifier output current to equal the desired load current, the current source thereby minimizing the magnitudes of transients caused when the switch means connects the amplifier output port to the current-source output port.

6. A voltage source, having a voltage-source output port adapted for connection to a load, for applying a desired load voltage to a load connected to the voltage-source output port, the voltage source comprising:

A. an electronic amplifier, having an amplifier output port, for producing at the amplifier output port an amplifier output voltage determined by amplifier input signals applied thereto;

B. switch means connected between the amplifier and voltage-source output ports and operable by application of control signals thereto selectively to connect and disconnect the amplifier output port to and from the voltage-source output port;

C. a voltage sensor for sensing the load voltage across a load connected to the voltage-source output port and producing a voltage-sensor signal indicative thereof; and D. control circuitry, connected for reception of the voltage-sensor signals and for application of control signals to the switch means and amplifier input signals to the electronic amplifier, for:

i. applying amplifier input signals to the electronic amplifier, while the switch means keeps the voltage-source output port disconnected from the amplifier port, to set the amplifier output voltage substantially equal to the load voltage indicated by the voltage-sensor signal, ii. applying control signals to the switch means to cause it to connect the amplifier output port to the voltage-source output port while the amplifier output voltage is substantially equal to the load voltage, and iii. thereafter applying amplifier input signals to the amplifier to cause the sensed load voltage to equal the desired load voltage, the voltage source thereby minimizing the magnitudes of transients caused when the switch means connects the amplifier output port to the current-source output port.

7. A method as defined in claim 3 where the stp of applying an analog amplifier input signal to the electronic amplifier comprises:

A. applying to the electronic amplifier, as the analog amplifier input signal, the voltage represented by the digital PID value only if the digital PID value is within a predetermined range; and B. applying a predetermined clamp voltage as the analog amplifier input signal if the digital PID value is outside the predetermined range.

8. A method as recited in claim 3 further comprising the steps of:

A. sensing the load voltage and setting the output voltage of the amplifier substantially equal to the sensed load voltage before connecting the amplifier output port across the load; and B. performing the step of connecting the amplifier to the load when the amplifier output voltage has reached the load voltage.

9. A method as defined in claim 8 where in the step of applying an analog amplifier input signal to the electronic amplifier comprises:

A. applying to the electronic amplifier, as the analog amplifier input signal, the voltage represented by the digital PID value only if the digital PID value is within a predetermined range; and B. applying a predetermined clamp voltage as the analog amplifier input signal if the digital PID value is outside the predetermined range.

10. A method as recited in claim 4 further comprising the steps of:

A. sensing the load voltage and setting the output voltage of the amplifier substantially equal to the sensed load voltage before connecting the amplifier output port across the load; and B. performing the step of connecting the amplifier to the load when the amplifier output voltage has reached the load voltage.

11. A current source for driving a desired load current through a load, the current source comprising:

A. an electronic amplifier, having an amplifier output port adapted for connection to a load, for producing at the amplifier output port an amplifier output voltage determined by amplifier input signals applied thereto and thereby causing an amplifier output current to flow in a load if the load is connected across the amplifier output port;

B. a sensor for sensing the amplier output current and producing an analog sensor signal indicative thereof;

C. an analog-to-digital converter, connected to receive the analog sensor signal and produce a digital sensor signal therefrom;

D. digital control means, connected to receive the digital sensor signal and adapted to receive a digital reference signal indicative of the desired load current, for digitally processing the digital sensor signal to determine a digital difference value representing the difference between the value represented by the digital sensor signal and that represented by the digital reference signal and to compute a proportional-integral-derivative (PID) value from the difference value, and for generating digital control signals representative of the PID value; and E. a digital-to-analog converter, connected to receive the digital control signals, for generating analog control signals therefrom the digital-to-analog converter being further connected to apply the analog control signals as amplifier input signals to the electronic amplifier so as to cause the amplifier output current to tend to equal the desired load current indicated by the digital reference signal.

12. A current source as defined in claim 11 wherein the digital con-rol means comprises meand for (i) determining whether the PID value is within a predetermined range, (ii) setting the digital control signals to represent the digital PID value only if the PID value is within the predetermined range, and (iii) setting the digital control signals to represent a predetermined clamp value if the PID value is outside the predetermined range.

13. A current source as defined in claim 11 wherein:

A. the current source further includes:

i. switch means connected to the amplifier output port, adapted for connection to the load, and operable by application of switch-control signals thereto selectively to connect and disconnect the amplifier output port to and from the laod;

ii. a voltage sensor for sensing the load voltage and producing analog voltage-sensor signals indicative thereof; and iii. a second analog-to-digital converter, connected to received the analog voltage-sensor signals and produce digital voltage-sensor signals therefrom; and B. the digital control means is connected for reception of the digital voltage-sensor signals and for application of switch-control signals to the switch means and includes means for:

i. applying digital control signals to the digital-to-analog converter, while the switch means keeps the current-source output port disconnected from the amplifier port, to cause the digital-to-analog converter to set the amplifier output voltage subvstantially equal to the load voltage indicated by the voltage-sensor signal, ii. applying switch-control signals to the switch means to cause it to connect the amplifier output port to the load while the amplifier output voltage is substantially equal to the load voltage, and iii. thereafter applying to the digital-to-analog converter the digital control signals representing the PID value.

14. A current source as defined in claim 13 wherein the digital control means comprises means for (i) determining whether the PID value is within a predetermined range, (ii) setting the digital control signals to represent the digital PID value only if the PID value is within the predetermined range, and (iii) setting the digital control signals to represent a predetermined clamp value if the PID value is outside the predetermined range.

15. A current source as defined in claim 11 wherein:

A. the current source further includes:

i. a voltage sensor for sensing the load voltage and producing analog voltage-sensor signals indicative thereof; and ii. a second analog-to-digital converter, connected to receive the voltage-sensor signals and produce digital voltage sensor signals therefrom; and B. the digital control means includes (i) a read-write memory for storing instructions for computing the PID value from the reference value and the digital sensor signal and (ii) means for executing the stored instruction, the read-write memory being operable to replace the instructions for computing the PID feedback signals from the reference value and the digital sensor signals with instructions for computing the PID signals from the reference value and the digital voltage-sensor signals so as to convert the current source to a voltage source.

16. A current source as recited in claim 15 wherein:

A. the current source further includes switch means connected to the amplifier output port, adapted for connection to the load, and operable by application of switch-control signals thereto selectively to connect and disconnect the amplifier output port to and from the load; and B. the digital control means is connected for reception of the digital voltage-sensor signals and for application of switch-control signals to the switch means and includes means for:

i. applying digital control signals to the digital-to-analog converter, while the switch means keeps the current-source output port disconnected from the amplifier port, to cause the digital-to-analog converter to set the amplifier output voltage substantially equal to the load voltage indicated by the voltage-sensor signal, ii. applying switch-control signals to the switch means to cause it to connect the amplifier output port to the load while the amplifier output voltage is substantially equal to the load voltage, and iii. thereafter applying to the digital-to-analog converter the digital control signals representing the PID value.

17. A voltage source for applying a desired load voltage to a load, the voltage source comprising:

A. an electronic amplifier, having an amplifier output port adapted for connection to a load, for producing at the amplifier output port an amplifier output voltage determined by amplifier input signals applied thereto;

B. a sensor for sensing the load voltage and producing an analog sensor signal indicative thereof;

C. an analog-to-digital converter, connected to receive the analog sensor signal and produce a digital sensor signal therefrom;

D. digital control means, adapted to receive a digital reference signal indicative of the desired load voltage and connected to receive the digital sensor signal, for digitally processing the digital sensor signal to determine a digital difference value representing the difference between the value represented by the digital sensor signal and that represented by the digital reference signal and to compute a proportional-integral-derivative (PID) value from the difference value, and for generating digital control signals representative of the PID value; and E. a digital-to-analog converter, connected to receive the digital control signals, for generating analog control signals therefrom, the digital-to-analog converter being further connected to apply the analog control signals as amplifier input signals to the electronic amplifier so as to cause the load voltage to tend to equal the desired load voltage indicated by the digital reference signal.

18. A voltage source as recited in claim 17 wherein:

A. the voltage source further includes switch means connected to the amplifier output port, adapted for connection to the load, and operable by application of switch-control signals thereto selectively to connect and disconnect the amplifier output port to and from the load; and B. the digital control means is connected for application of switch-control signals to the switch means and includes means for:

i. applying digital control signals the digital-to-analog converter, while the switch means keeps the current-source output port disconnected from the amplifier port, to cause the digital-to-analog converter to set the amplifier output voltage substantially equal to the load voltage indicated by the voltage-sensor signal, ii. applying switch-control signals to switch means to cause it to connect the amplifier output port to the load while amplifier output voltage is substantially equal to the load voltage, and iii. thereafter applying to the digital-to-analog converter the digital control signals representing the PID value.

* * * * *